US006390177B1

(12) United States Patent
Arvedi et al.

(10) Patent No.: US 6,390,177 B1
(45) Date of Patent: May 21, 2002

(54) CONTACT MOULD FOR THE CONTINUOUS CASTING OF STEEL SLABS

(75) Inventors: Giovanni Arvedi, Via Mercatello 26; Mario Caldonazzo, both of Cremona; Luciano Manini, Azzanello; Andrea Bianchi, Piadena; Angelo Visigalli, Cavacurta, all of (IT)

(73) Assignee: Giovanni Arvedi, Cremona (IT)

( * ) Notice: Subject to any disclaimer, the term of this patent is extended or adjusted under 35 U.S.C. 154(b) by 0 days.

(21) Appl. No.: 09/498,907

(22) Filed: Feb. 4, 2000

Related U.S. Application Data

(63) Continuation of application No. PCT/IT98/00218, filed on Jul. 29, 1998.

(30) Foreign Application Priority Data

Aug. 4, 1997 (IT) ..... MI97A1875

(51) Int. Cl.[7] ..... B22D 11/00
(52) U.S. Cl. ..... 164/418; 164/459
(58) Field of Search ..... 164/418, 459

(56) References Cited

U.S. PATENT DOCUMENTS 5,311,922 A * 5/1994 Streubel ..... 164/418
5,460,220 A * 10/1995 Coassin ..... 164/483
5,520,242 A * 5/1996 Streubel et al. ..... 164/418

FOREIGN PATENT DOCUMENTS

| | | |
|---|---|---|
| DE | 887 990 | 8/1953 |
| DE | 35 01 422 | 8/1985 |
| DE | 39 07 351 | 9/1990 |
| DE | 41 31 829 | 10/1993 |
| EP | 0 149 734 | 4/1988 |
| EP | 0 552 501 | 7/1993 |
| EP | 0 611 619 | 8/1994 |
| EP | 0 658 387 | 6/1995 |

* cited by examiner

*Primary Examiner*—Nam Nguyen
*Assistant Examiner*—I.-H. Lin
(74) *Attorney, Agent, or Firm*—Akin, Gump, Strauss, Hauer & Feld, L.L.P.

(57) ABSTRACT

An improved mould for the continuous casting of steel slabs having thickness in the range from 50–120 mm, particularly suitable to be rolled to thin strips, presents two large faces (F), each one having in horizontal cross section a concave or rectilinear central zone symmetrical with respect to each other, connected at both sides to the narrow faces (f) through concave-convex wide bends with respect to the internal part of the mould, without other lengths being parallel to opposite portions of the other face (F), besides to a possible central rectilinear length. the radiuses of the concave portion (r1) and of the convex portion (r2) are in a mutual ratio of a range from 0.6 to 1.4, these portions being preferably the same at each horizontal cross section of the mould and increasing downwards, while the depth (a) of the concavity decreases downwards, being possibly constant from a height (ybc) to the outlet section, but being preferably continuously decreasing along the whole length of the mould, with a residual depth ≦5 mm at the outlet zone.

12 Claims, 5 Drawing Sheets

Z
Z
X
X
Ce(r>0)
Ce(r=∞)
α
β
t1
t2
t3
r1
r2
rc
b
b
01
02
0c

CONTACT MOULD FOR THE CONTINUOUS CASTING OF STEEL SLABS

This application is a continuation of PCT/IT98/00218 filed Jul. 29, 1998.

BACKGROUND OF THE INVENTION

The present invention relates to an improved mould, with improved contact features, for the continuous casting of steel slabs having a thickness in the range of 50–120 mm, particularly suitable to be rolled to thickness values of thin strip, i.e. even less than 1 mm.

German Patent No. 887990 discloses a water-cooled mould for the continuous casting of metallic slabs which in the inlet upper zone is basically in the shape of a funnel with central enlargement, whereinto the submerged nozzle opens, gradually decreasing downwards along the mould, to reach, well before the actual outlet, width values equal to the thickness of the slab leaving the mould.

The successive European Patent No. 0149734 aimed at avoiding a solidification localized in the zone near to the narrow faces, wherein the larger sides converge, to occur as a result of the mould narrowing towards the smaller sides, being funnel-shaped with angularly disposed walls, leading also to the consequence (however not supported by practical experimentation) of the cast flow being blocked. This problem was solved by providing that, at the side of the funnel-shaped casting zone, the larger side walls extend flat and parallel to each other. However, this kind of mould is very likely to involve turbulence problems in the zones with parallel walls, lateral with respect to the central concavity, lacking the desirable draining of refluxes caused by upward directed streams of molten metal from the submerged nozzle. The consequences of this fact are negative for the final product surface quality and affect particularly ultra-thin rolled products because of the powders being trapped in the steel. From DE-A-4031691 a mould for thin slabs is known, having a central hollow or concavity of the two opposite forming plates, which plates show a first section, starting from the inlet zone of the mould, being basically vertical until about half-height, having then a curved profile at the end zone of outlet of the mould, with radius of curvature for the internal or intrados plate which is equal to the one for the external or extrados plate, reduced by the thickness of the thin slab. A mould with plates shaped according to these features was found not to solve the problem of a possible detachment of the casting product from the walls in the sections with a sudden curvature change, although it offers certain advantages with respect to previous moulds, especially as far as cooling homogeneity is concerned.

This brings about a longitudinal discontinuity that not only implies non uniform cooling, but also can cause both compressive and tensile local mechanical stresses, respectively at the intrados and at the extrados, with possibility of cracks or fractures of the skin in the mostly stressed zones, until causing to the so-called "break-outs". In order to avoid these troubles Italian Patent No 1265065 in the same applicant's name modified the longitudinal profile of the mould so that a vertical section of the two forming plates is composed of a certain number of curve lines, connected to each other, having upwards increasing radiuses of curvature to an almost infinite value, with vertical tangent at the inlet.

Unsolved problems of turbulence at meniscus were further tackled in the patent application MI 96A002336 in the same applicant's name, which provided optimized parameters, at high casting rate conditions, in the form of ratios of the area included between submerged nozzle and mould large faces to the remaining area portions of the same cross-section, as well as between submerged nozzle and smaller sides, and respective parameters defining said areas, trying this way to improve the behaviour at the meniscus without modifying the plates profile in horizontal cross-section.

Other moulds for continuous casting are known for example from EP-A-0658387 and DE-C-4403045, the first one with large faces in the shape of arcs of circle, being convex in cross-section, and the second one at constant concavity, but neither of them having an optimal contact with the slab skin. The same can be said about Japanese published patent application No 51-112730 that provides a mould with large opposed faces having a curved, respectively concave or convex profile, symmetrical with respect to two orthogonal median axes and connected at its ends to a rectilinear profile.

Also EP-A-0611619 discloses a mould for continuous casting with a central cavity having a convex-concave shape, wherein the ratio between the convex radius to the concave radius should be between 1.5 and 3.0. The cavity depth is decreasing towards the mould outlet, but the radius of the central cavity does not increase constantly towards the mould outlet, being constant for a part of the terminal portion. This lack of continuous variation of the radius and the fact that the lateral sections of both large faces are parallel (therefore are not bent) give rise to some discontinuity in guiding the slab skin while maintaining the contact with the mould plates.

BRIEF SUMMARY OF THE INVENTION

This invention aims therefore at providing a mould allowing continuous contact with the slab skin in every point of horizontal and vertical cross-sections, during the withdrawal of the slab. A homogeneous cooling is thus obtained, allowing both a uniform thickness of the skin along the whole profile of the same cross-section and a continuous variation of the thickness according to the height of the varying cross-section, to be achieved, these conditions being ideal to avoid shrinkages and irregular stresses unavoidably leading to longitudinal cracks on the slab surface.

Further, it is desirable to obtain at meniscus level a reduced rate of the upward directed streams of steel at the mould sides to have in these areas very low stationary waves, with remarkable advantages for the surface quality of final products.

This is achieved by a particular concave shape of the mould that gives to its large faces a definite conicity through concave-convex wide bends (therefore, not merely concave or convex like according to the above-mentioned Japanese publication) connecting narrow faces to the central rectilinearly profiled zone of the concavity.

BRIEF DESCRIPTION OF THE SEVERAL VIEWS OF THE DRAWINGS

These and other purposes, advantages and features of the improved mould according to the present invention will be more clearly understood from the following detailed description of one preferred embodiment, given as a non-limiting example with reference to the attached drawings, wherein.

DETAILED DESCRIPTION OF THE INVENTION

Figure 2A:
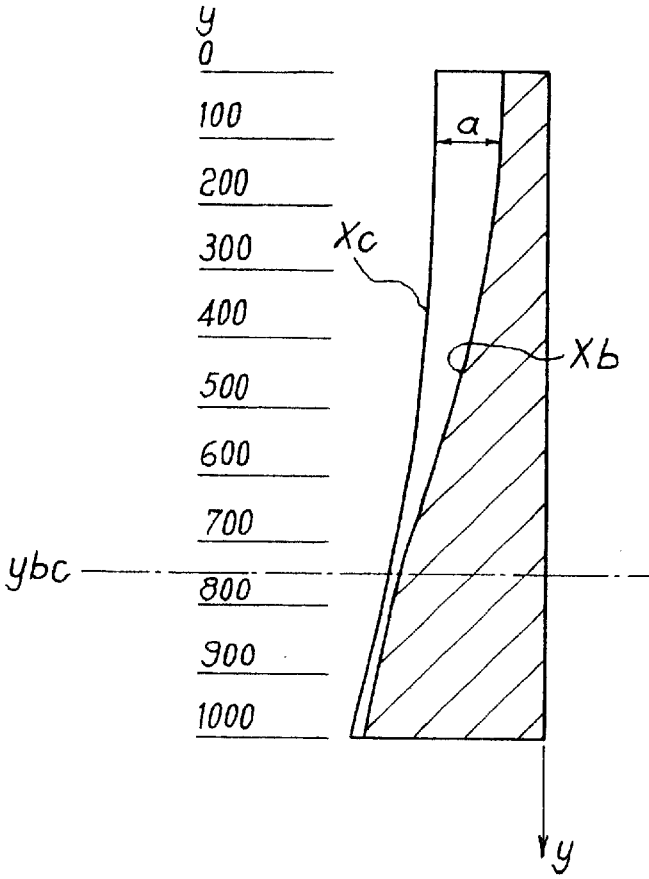
FIG. 2*a* and FIG. 2*b* show schematic views in vertical section, taken along the vertical plane passing through the median axis X—X drawn in FIG. 1, limited to the extrados plate, of two moulds with a different profile, with several adjoined radiuses as in the Italian patent 1265065 and with a straight profile respectively, in a first embodiment as far as the trend of the concavity depth is concerned.

With reference to the drawings, a mould according to the present invention consists of two facing copper plates, with internal faces which, in addition to a central concavity of varying depth a, can show different vertical trends, as shown by way of example in FIGS. 2*a,* 2*b* and 3*a,* 3*b*. Said plates, and particularly their active internal faces or "large faces" F, are water-cooled and laterally enclosed by two "narrow faces" f, also said shoulders, their location determining the width of the slab.

Figure 4:
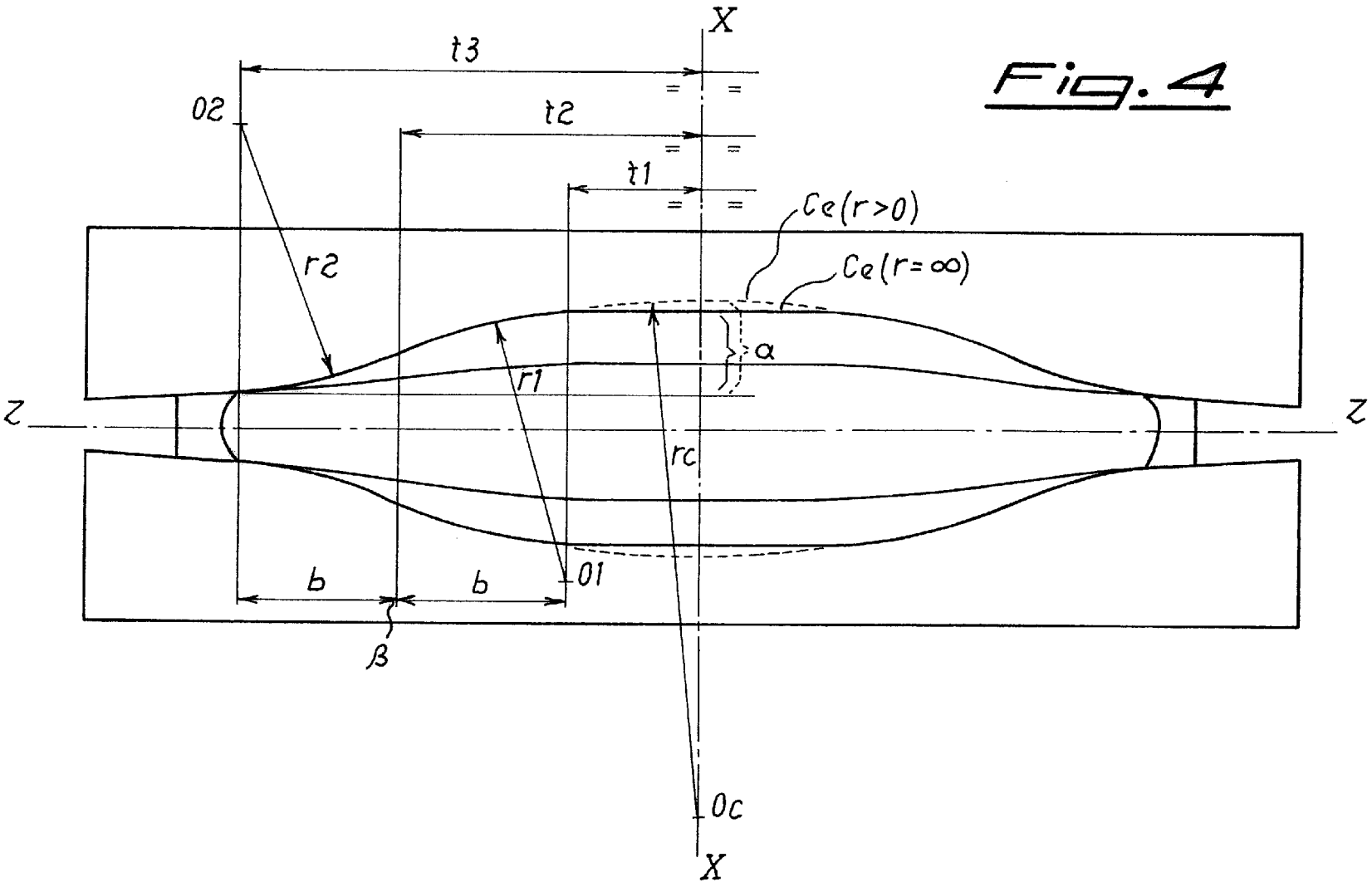
FIG. 4 shows a schematic top plan view of the plates of the mould of FIG. 1 in a first embodiment of their horizontal profile, orthogonal with respect to that shown in FIGS. 2 and 3.
Figure 5:
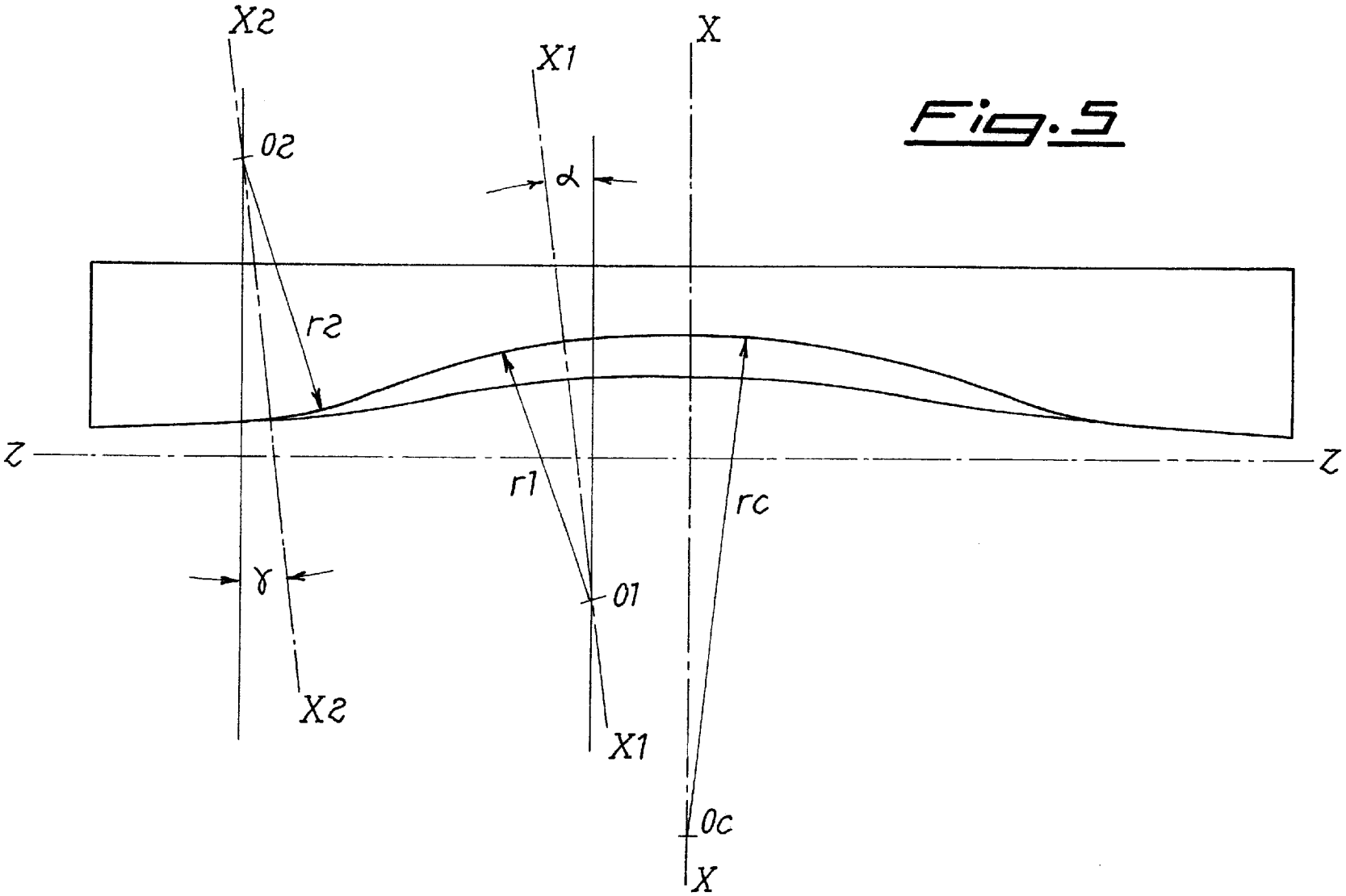
FIG. 5 shows a view, in a greater geometric detail, again as a top plan view, of one plate of the mould in a different embodiment of its horizontal profile.

According to the present invention the large faces F comprise a central portion Ce of reduced length 2t1, rectilinear or curved, more precisely concave with respect to the inside of the mould, that can be considered as generated by a radius rc≧10 m centered in Oc on the transversal median axis X—X, as can be appreciated in FIG. 4. When rc=∞, Ce has a rectilinear trend, its length corresponding to t1, as drawn with a continuous line in FIG. 4, while when rc has finite values, more o less curved trends are obtained, like in FIG. 5 or in the dot representation of FIG. 4. In every case, rc is constant and the center Oc is fixed in every mould cross-section, while Ce portion is symmetric to that in the facing plate with respect to a vertical plane passing through the median axis Z—Z orthogonal to X—X.

Figure 1:
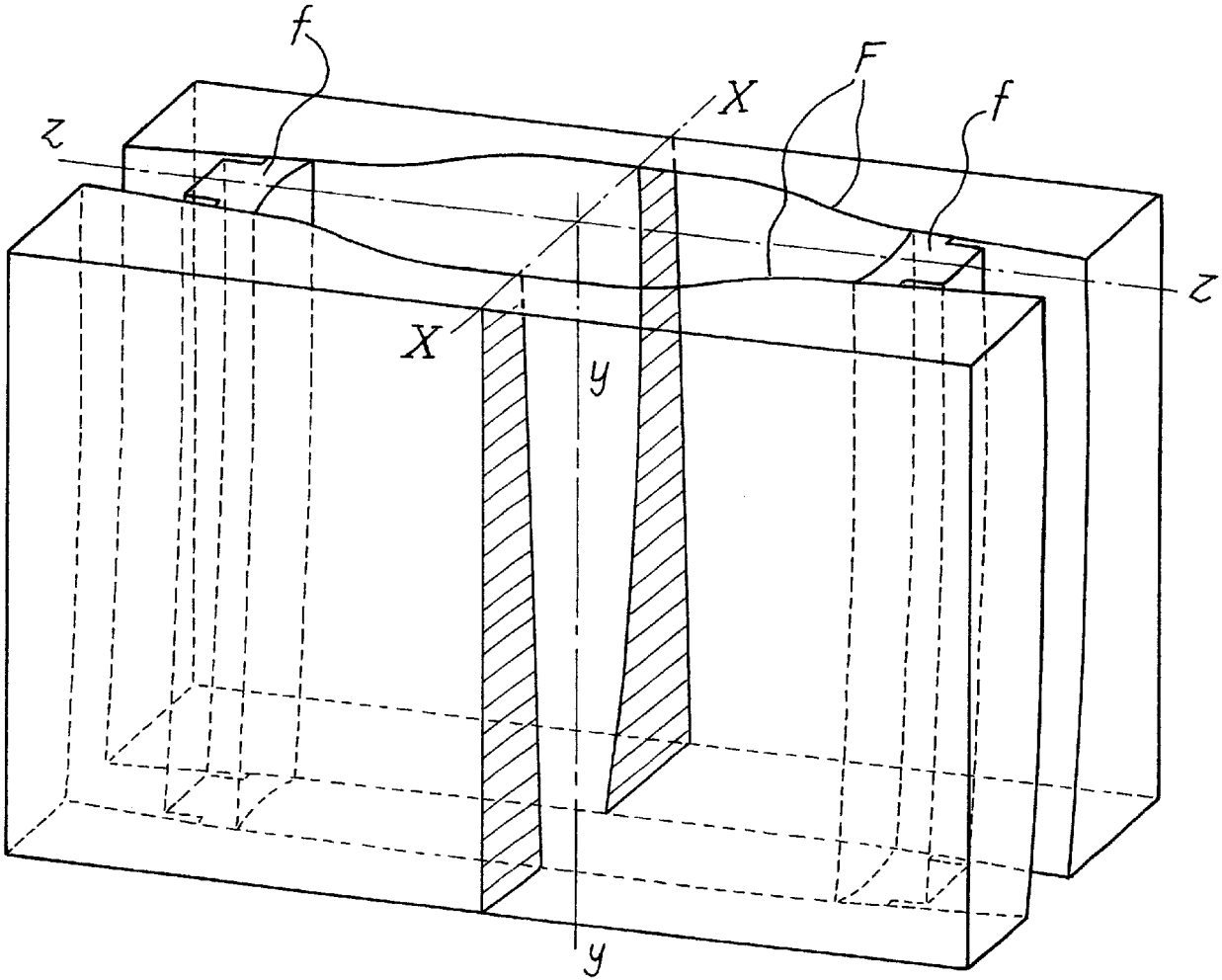
FIG. 1 is a schematic, perspective view of a mould according to the present invention.

Still referring to FIG. 4, each Ce length is connected, symmetrically with respect to the median plane X—X, to the narrow faces f on both sides through concave-convex wide bends, with respect to the internal part of the mould, its central zones Ce being the only possible parallel lengths, when they are rectilinear, with rc=∞. At any horizontal cross-section of the mould, starting from the Ce length, a concave arc is first found, its center O1 being located on a straight line X1 forming with the X—X axis an angle α≧0°, connected to Ce. This concave arc continues to a distance t2 from the median transversal axis X—X, in other words to a flex point β, where the curve becomes convex having the bending center O2 opposed to O1 on a straight line X2 forming with X—X axis an angle γ≧0°. Bending centers O1 and O2 lay on the same plane and the radiuses r1 and r2 are in a mutual ratio between 0.6 and 1.4. If the ratio r1: r2 is out of this range, the bend at a distance t1 (r1:r2≦0.6) or near the distance t3 from axis X—X (r1:r2≧1.4) is excessive and does not ensure the best contact between the outer surface (skin) of the slab and the copper plates, whereby cracks are induced which may result in breakouts, without considering the negative effects on the steel quality. Preferably their ratio is 1, the two radiuses being equal with r1=r2=r at every horizontal cross-section of the mould, taken at anyone of the levels shown along the y axis in FIG. 1. In this case the angles α and γ are equal. The values of r1 and r2 are in all cases increasing for y level increasing downwards. Particularly, according to a preferred embodiment of the present invention (considering the profile of the plates in horizontal cross-section) shown in FIG. 4, where r1=r2=r, the flex points β between concave and convex portion are at half of the distance, having the measure b, between the beginning of the narrow face f and the end of the central portion Ce which extends, on both sides, for a distance t1 from the central axis X—X (its length measuring 2t1 when rc=∞). Consequently in this case b=t2−t1, where t1 is the distance of the flex point β from the transversal median axis X—X. It is worth noting that, with rc→∞, the angles α and γ are null, that is, straight lines X1 and X2 where centers O1 and O2 are located are parallel to the X—X axis when the portion Ce is rectilinear, as can be appreciated with reference to FIG. 4. It follows from the foregoing that the whole active part of the large faces coincides with the concavity, that extends, substantially symmetrical with respect to the Z—Z axis along a t3 portion and perfectly symmetrical with respect to the median axis X—X; the concavity width can be considered coinciding with that of the mould when narrow faces f are at a distance t3 from the median axis X—X.

Figure 2B:
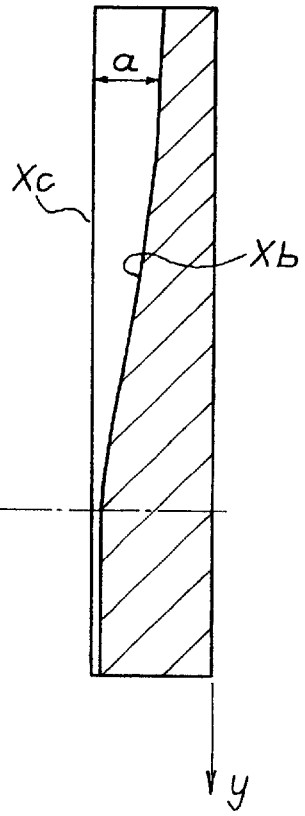
Figure 3A:
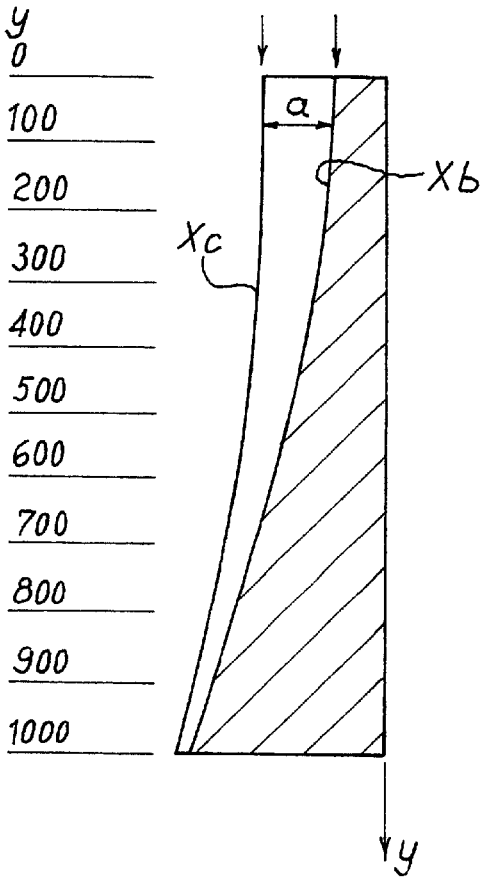
FIG. 3*a* and FIG. 3*b* show similar views as FIGS. 2*a* and 2*b* in a preferred embodiment of the continuously downwards decreasing trend of the concavity depth.
Figure 3B:
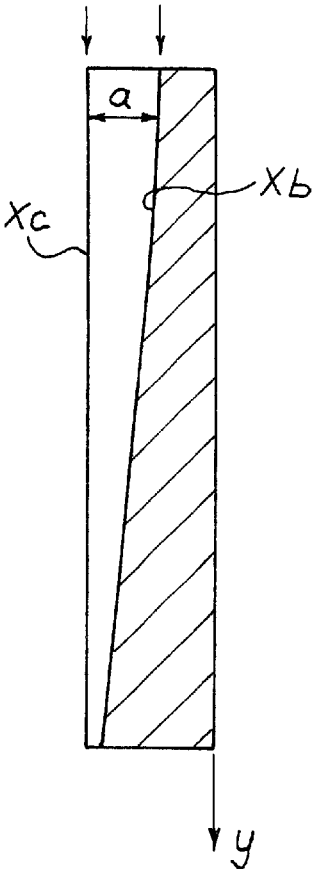

The concavity has a depth a, shown, in addition to FIG. 4, in FIGS. 2*a,* 2*b* and 3*a*, 3*b* with a=Xc-Xb, with Xc and Xb being the distances respectively of the internal lateral profile of the mould (at a distance t3 from the axis X—X) and of the deepest part of the concavity, in t1, from the vertical axis y considered coinciding with the outer wall of the plate. Its value varies in the vertical direction, according for instance to Italian patent No 1265065, in case decreasing to a certain level of the mould, (referred as ybc in FIGS. 2*a* and 2*b*) and being constant (and in any case a≦5 mm) beyond that level to the outlet. However the depth value a will be preferably continuously decreasing from the upper section or inlet portion with y=0 to the bottom or outlet section, with a residual depth ≦5 mm, as shown in FIGS. 3*a,* 3*b*. It is worth noting that, in FIGS. 2*a,* 2*b* at constant a≦1.75 mm for levels lower than ybc, and for any shape of the central portion Ce (rectilinear or concave) a further connecting portion with constant radius (not shown) having a bending center opposite to O2, from the inlet, that is from y=0 to the mould outlet, is provided between the O2 centered convex connecting portion and the end portion, non parallel, of the large faces F.

It is also worth noting that, with t3 indicating the half-width of the concavity, its depth a, and possibly the value of the radius r=r1=r2 (as will be later apparent), has been found to be preferably a function of the distance t3−t1 (coincident with 2*b* when r1=r2). The casting is in fact only possible when: a≦0.15(t3−t1) at the inlet, that is for y=0, where depth is the largest. The casting would be seriously damaged if the ratio between the concavity depth and the length of the concave-convex bend of the large faces, through which the central portion Ce is connected to the narrow faces, would be higher than this value.

The concavity depth a, continuously varying either along the whole length of the mould, or along the possibly limited portion with a variable value from the inlet to ybc (FIGS. 2*a*, 2*b*), is moreover preferred to be inversely proportional dimensionally to the level y, decreasing when the level increases downwards, in particular in the second case there being a≦0.1 (ybc) at the inlet, that is with y=0.

Remaining within said limits and with the consequent radiuses of curvature, the slab is assured to find always narrower sections during its forward movement in the casting direction, which offers the advantage of accompanying the normal material shrinkage, avoiding detachments from the walls. Besides, casting powders, producing lubricating fluid scales, work better in the absence of lateral parallel zones preventing the draining of refluxes of molten steel caused by upward directed streams from the submerged nozzle, giving rise to undesirable turbulences. Particularly, when the surface quality is important, the absence of turbulences causing the incorporation of casting powders, having well known consequences, is crucial. As mentioned before, the formula: $r=(4b^2+a^2)/4a$, function of the concavity depth a and of the distance b, can be very useful for the calculation of the radiuses of curvature of the concave-convex surfaces, when r=r1=r2. Therefore, by way of example, employing the above mentioned parameters, for a mould being 1 meter large and 1 meter long, with a central portion having a width of 260 mm, that is 2t1, not necessarily rectilinear, being therefore t3=500 mm and t1=130 mm, it follows:

$$b=(t3-t1)/2=185 \text{ mm}$$

At the inlet section, for a mould of the kind described for instance in Italian patent No 1265065 the value of a can be expected to be about 24 mm, this value being certainly <0.15×2b (that is 55.5 mm). The above mentioned first condition for the concavity depth is therefore satisfied. The radius of curvature, for the connecting concave portion, equal to the corresponding counter-radius for the convex part, results, from the application of the above reported formula:

$$r=\frac{4\times 185^2+24^2}{4\times 24}=\frac{136.900+576}{96}=1432 \text{ mm}$$

As stated above, instead of a continuously decreasing concavity depth, in the lower part of the mould, a constant concavity depth can be assumed (beyond the possible ybc level and down to the bottom of the mould) (FIGS. 2*a,* 2*b*) with a minimal value, for instance, of 0.7 mm, (and anyway <5 as previously defined), and the value of r in this case is 45,000 mm, the radius of curvature being therefore much greater in that portion. Given the a value in that portion, as previously stated, a further connecting concave length will be necessary in the mould outer zone, at a distance t3 from the X—X axis.

Obviously, in every case, at every level of the mould a assumes slightly different values when the intrados or the extrados is considered, and the radiuses r1 and r2 therefore reflect such slight variations considering the above reported formula.

It is worth noting that the length tl of central portion Ce (and the same arc, the radius rc being constant) is preferably the same for all horizontal cross-sections from the inlet to the bottom of the mould, but this length can obviously vary gradually, increasing or decreasing, with the mould width or, possibly, with its level.

Finally, as can be appreciated especially in FIG. 4, the condition of absence of parallel portions, excluding in case the central portion Ce (coincident with t1 when rc=∞), generally referred to the only active parts of the mould, is applicable preferably also to the normally inactive portion of the large faces F beyond the shoulders or narrow faces f, which is indicated with angled and outside-converging lines. This condition results suitable for avoiding undesirable outward movements of the shoulders, under the thrust of ferrostatic pressure, giving rise to the so-called "conicity loss".

What is claimed is:

1. A mould for the continuous casting of steel slabs having a thickness in the range from about 50 to 120 mm, the mould comprising two pairs of plates defining two inwardly facing narrow faces (f) between two opposite inwardly facing large faces (F), each large face having a profile which is symmetric with respect to a first median axis (X—X) in horizontal cross-section and a profile, at a vertical outer section, which is complementary to said narrow faces (f) at a first distance (t3) from said first median axis (X—X), a central concavity having a depth (a) varying along at least a first length from an upper inlet, the depth (a) being defined by a differential distance between two distances measured, respectively, from a vertical axis (y) coincident with an outer wall of one of the plates which defines the large faces to an innermost profile at a center of the concavity and, respectively, to a side profile at the first distance (t3) from the first median axis (X—X), said concavity being defined by opposite central portions (Ce) in horizontal cross-section having a second length (2t1), symmetrical with respect both to the first median axis (X—X) and to a second median axis (Z—Z) orthogonal to said first median axis (X—X) between said two large faces (F), said concavity at both sides of said large faces (F) proximate said narrow faces (f) having wide bends symmetrical to said first and second median axes (X—X) and (Z—Z), said wide bends having bending radii (r1 and r2, respectively) having values that increase toward a mould outlet, while the depth (a) of the concavity decreases toward the mould outlet such that said first concave radius (r1) and first convex radius (r2) have a mutual ratio (r1/r2) ranging from about 0.6 to 1.4 at each horizontal cross-section of the mould.

2. A mould according to claim 1, wherein the depth (a) of the concavity continuously decreases from said upper inlet (at y=0) to said mould outlet, with a residual depth of ≦5 mm at the mould outlet.

3. A mould according to claim 2, wherein the central portion (Ce) has the second concave of radius (rc) of ≧10 m, which is constant at each horizontal cross-section of the mould, having a first bending center (Oc) located along the first median axis (X—X) to establish a concave arc.

4. A mould according to claim 1, wherein the central portion (Ce) has a second concave radius (rc) of ≧10 m, which is constant at each horizontal cross-section of the mould, having a first bending center (Oc) located along the first median axis (X—X) to established a concave arc.

5. A mould according to claim 4, wherein a second bending center (O1) of the concave portion of the curve of the first concave radius (r1) is established by, a first straight line (X1), at a first inclination angle (α≧0°) from said first median axis (X—X) and a third bending center (O2) of the convex portion of the curve of the second convex radius (r2), is established by second straight line (X2) at a second inclination angle (γ) of ≧0° from said first median axis (X—X).

6. A mould according to claim 5, wherein the second concave radius (rc) of said central portion (Ce) is infinite, whereby the first inclination angle (α) of the first straight line (X1) on which the second bending center (O1) is located is zero.

7. A mould according to claim 4, wherein, at said upper inlet (at y=0), the depth (a) of the concavity is ≦0.15 (t3−t1), where a third distance (t1) is the half width of the concavity corresponding to said central portion (Ce).

8. A mould according to claim 1, wherein said mutual ratio (r1/r2) is equal to 1 and a radius value (r=r1=r2) is given by the following relation:

$$r=(4b^2+a^2)/4a$$

where (a) is said concavity depth and a second distance (b) is equal to (t3−t1)/2 and is defined as the half distance between one end of the central portion (Ce) and a point on the concavity corresponding to a flex point (β) between the concave and convex bending radii (r1 and r2, respectively).

9. A mould according to claim 1, wherein the depth (a) of the concavity is constant from a level (ybc) to said mould outlet.

10. A mould according to claim 9, wherein, at said upper inlet (at y=0), the depth (a) of the concavity is ≦0.1 (ybc).

11. A mould according to claim 9, wherein, the value of the depth (a) of the concavity of ≦1.75 mm is constant between the level (ybc) and said mould outlet and, an adjoining arc is provided with a constant concave radius between a portion of said large face (F), defined by said first convex radius (r2), and a portion of said large face (F) proximate said narrow face (f).

12. A mould according to claim 1, wherein the second length (2t1) of the central portion (Ce) is constant for all the horizontal cross-sections.

* * * * *